US006283821B1

(12) United States Patent
Wang

(10) Patent No.: US 6,283,821 B1
(45) Date of Patent: Sep. 4, 2001

(54) BRASSIERE SASH

(76) Inventor: Wen-Da Wang, No. 9-1 Shin Ho 2 Road, Tainan (TW)

( * ) Notice: Subject to any disclaimer, the term of this patent is extended or adjusted under 35 U.S.C. 154(b) by 0 days.

(21) Appl. No.: 09/754,271

(22) Filed: Jan. 5, 2001

(51) Int. Cl.[7] ..... A41C 3/00
(52) U.S. Cl. ..... 450/88; 450/86; 450/1; 2/311
(58) Field of Search ..... 450/88, 86, 1, 450/7–11, 17, 30, 31–33, 82, 87, 38, 57, 58, 92, 93; 2/69, 105, 455, 106, 80, 83, 78.1, 311, 312, 338, 273, 267, 268, 275, 73; 623/7, 8; 239/36, 152, 153, 653; 512/1, 4

(56) References Cited

U.S. PATENT DOCUMENTS 2,849,723 * 9/1958 Marino ..... 450/88
3,311,112 * 3/1967 Murray ..... 450/88
5,023,956 * 6/1991 Fox ..... 2/338
5,782,671 * 7/1998 Suen et al. ..... 450/38
5,944,578 * 8/1999 Lin et al. ..... 450/57
5,989,101 * 11/1999 Jenn-Shyang et al. ..... 450/57
6,015,332 * 1/2000 Lee et al. ..... 450/57
6,089,953 * 7/2000 Chen ..... 450/1
6,155,906 * 12/2000 May ..... 450/88
6,179,687 * 1/2001 Lee et al. ..... 450/88
6,186,861 * 2/2001 Flaherty ..... 450/1

* cited by examiner

*Primary Examiner*—Gloria M. Hale
(74) *Attorney, Agent, or Firm*—Rosenberg, Klein & Lee

(57) ABSTRACT

A brassiere sash made of two overlapping pieces of transparent thermoplastic polyurethane. The circumferential edges of the overlapping pieces are joined with high frequency energy to form a central cavity between two overlapping pieces. The central cavity is filled with liquid, perfume and ornamental glittering articles. Each end of the brassiere sash is passed through a buckle ring and then attached to a predetermined position of the brassiere sash.

2 Claims, 5 Drawing Sheets

BRASSIERE SASH

BACKGROUND OF THE INVENTION

1. Field of the Invention

The present invention relates to a brassiere sash with innovative features, and more particularly to a brassiere sash which is made of transparent thermoplastic polyurethane (TPU) and is provided with a central cavity filled with liquid, perfume and ornamental glittering articles, so as to look vivid, glittering and beautiful.

2. Description of the Related Art

Ladies today are becoming more and more tasteful about brassieres. They pay much attention to the practical effect of comfort, protection and the support of the brassiere body.

Referring to FIG. 1, although the brassiere body 20 has been constantly improved, the conventional brassiere sashes 10 have been ignored by brassiere manufacturers and users, so that the sashes keep the same style and continue o be made of cotton or fiber. They lack an ornamental visual effect. Modern women would like to add various ornaments on their clothes, so as to become more fashionable. Modern women of the "e-generation" would have another fashion choice if brassiere sashes 10 were improved with some creativity.

SUMMARY OF THE INVENTION

Therefore, it is an object of the present invention to provide a brassiere sash that substantially obviates the drawbacks of conventional brassieres.

An object of the present invention is to provide a brassiere sash which is made of a transparent TPU, and is provided with a central cavity filled with liquid, perfume and ornamental glittering articles, so as to look vivid, glittering and beautiful.

Accordingly, a brassiere sash of the present invention is made of two overlapping pieces of transparent material, TPU. The circumferential edges of the overlapping pieces are pressed together and joined with high frequency energy, to form a central cavity between the two overlapping pieces. After the central cavity is filled with liquid, perfume and ornamental glittering articles, each end of the brassiere sash is passed through one buckle ring and then attached to a predetermined other portion of the brassiere sash, so as to finish the vivid, glittering and beautiful brassiere sash.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
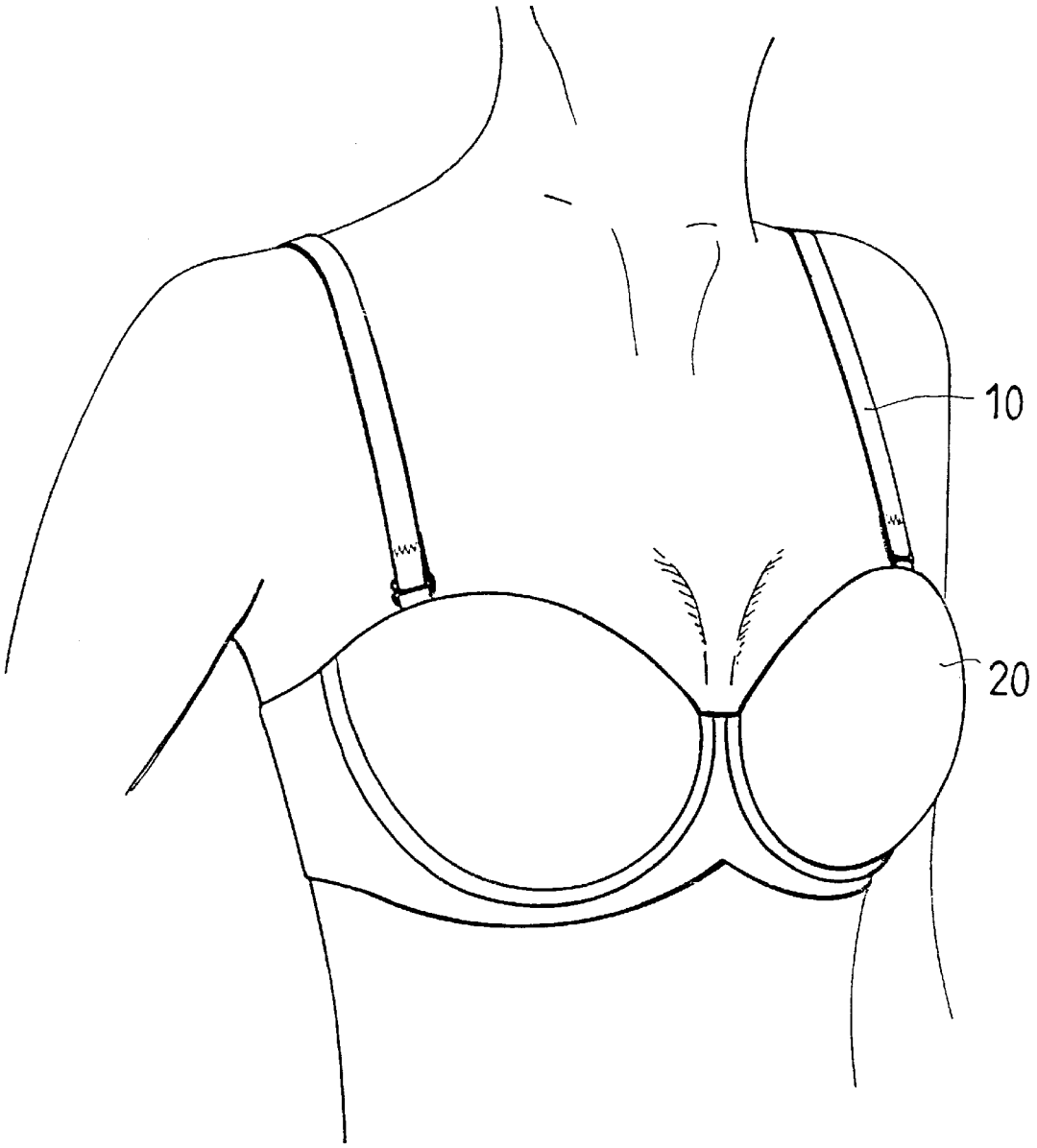
FIG. 1 (PRIOR ART)
FIG. 1 is a perspective view of the conventional brassiere sashes assembled to a brassiere worn by a user.
Figure 2:
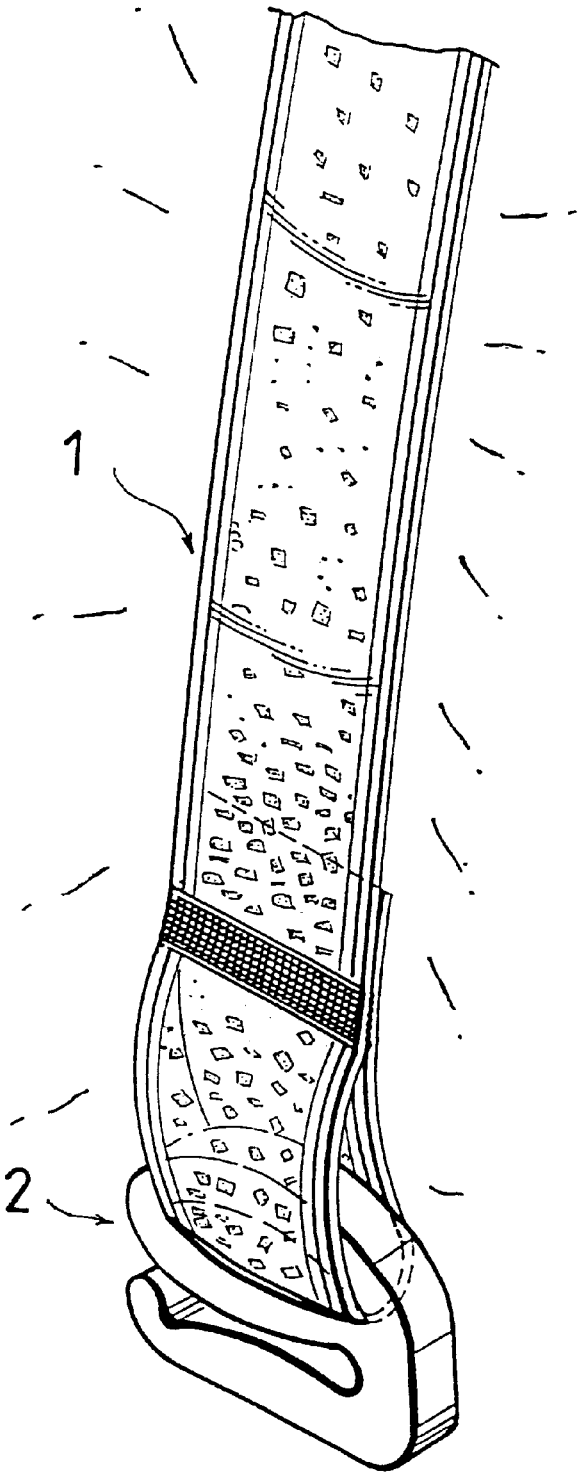
FIG. 2 is a perspective view of an embodiment of the brassiere sash showing one end assembled to a buckle ring in accordance with the present invention.
Figure 3:
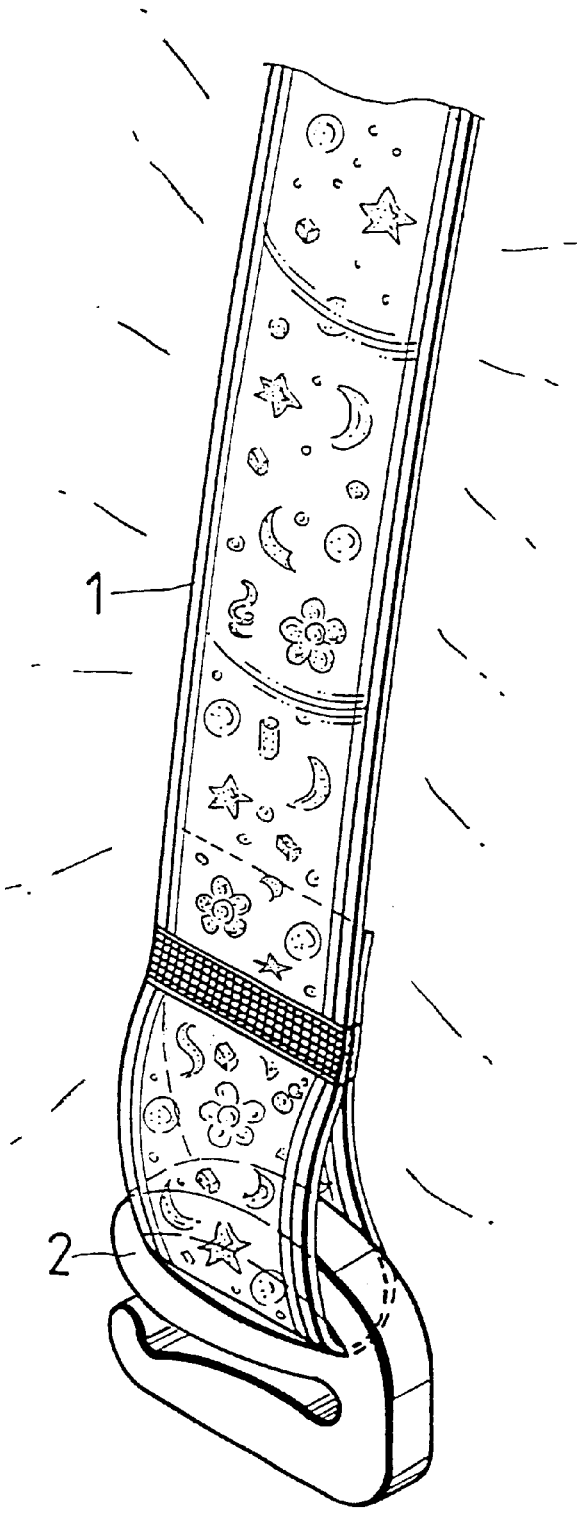
FIG. 3 is a perspective view of another embodiment of the brassiere sash showing one end assembled to a buckle ring in accordance with the present invention.
Figure 4:
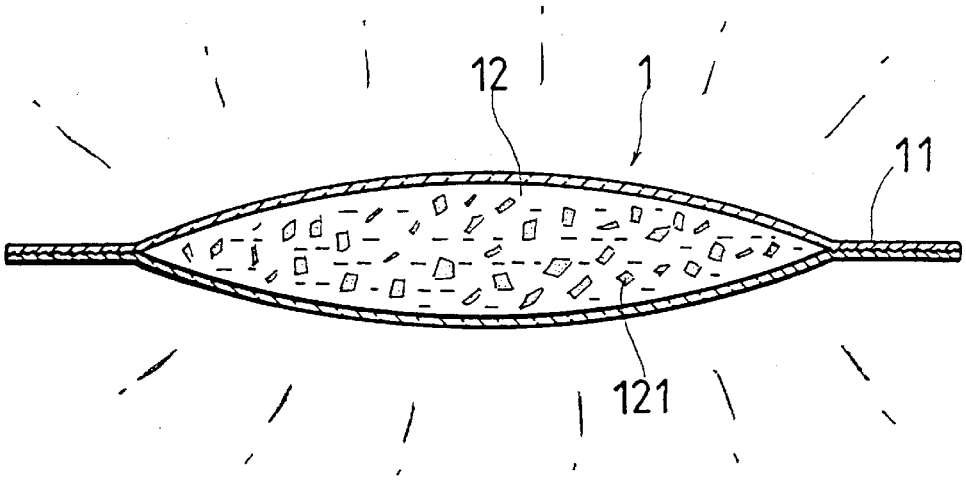
FIG. 4 is a sectional view of an embodiment of the brassiere sash in accordance with the present invention.
Figure 6:
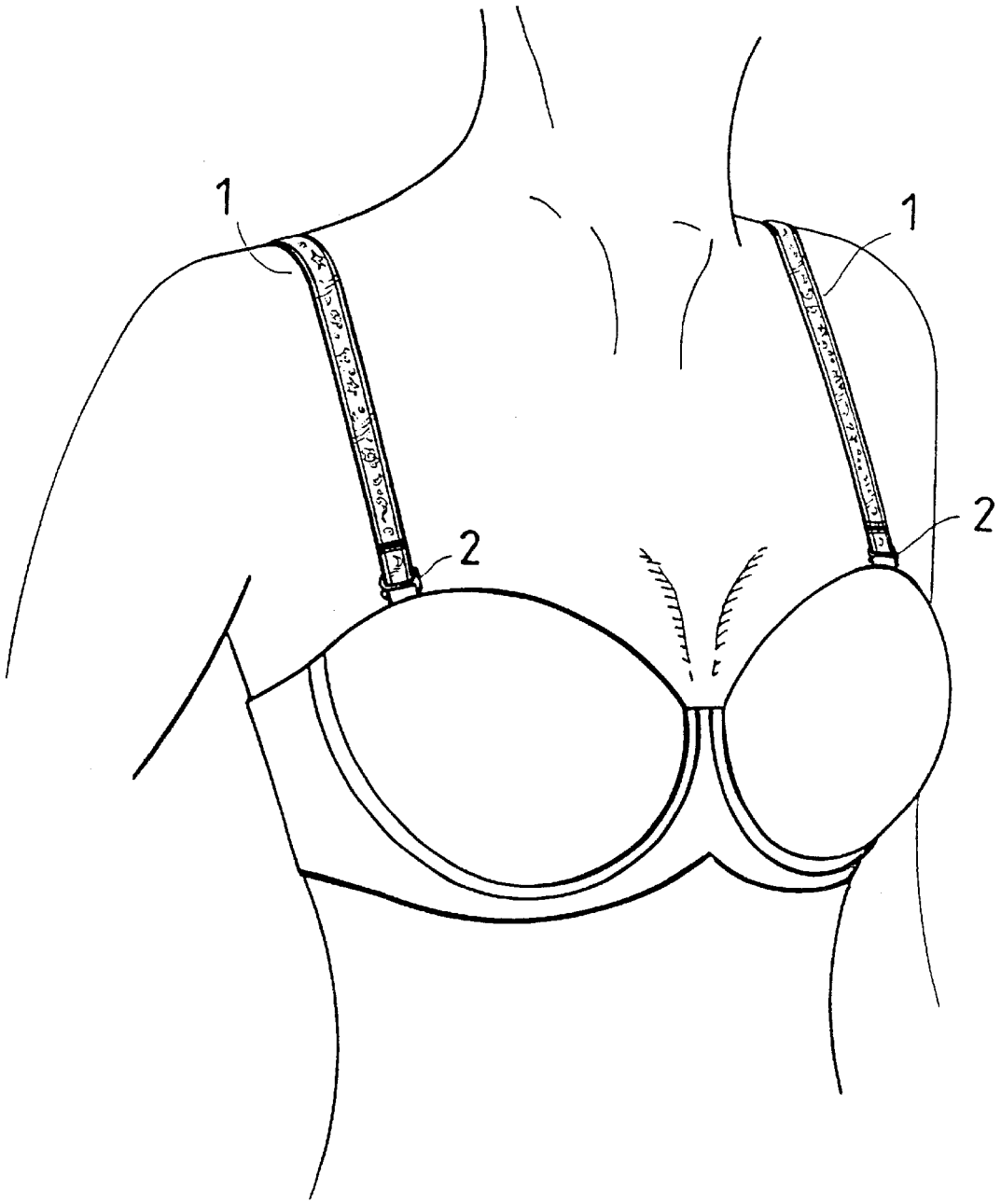

Referring to FIGS. 2, 3 and 4, the brassiere sash 1 of the present invention is made of two overlapping pieces of transparent thermoplastic polyurethane (TPU). The circumferential edges 11 of the overlapping pieces are joined with high frequency energy to form a central cavity 12 between the two overlapping pieces. After the central cavity 12 is filled with liquid, perfume and ornamental glittering articles 121 (such as tinsels, various shaped pieces made of fluorescent powder, etc.), each end of the brassiere sash 1 is passed through a buckle ring 2 and then attached to a predetermined other portion of the brassiere sash 1, to form a vivid, glittering and beautiful brassiere sash 1. The brassiere sashes 1 are assembled to a brassiere by the buckle rings 2, as shown in FIG. 6.

Figure 5:
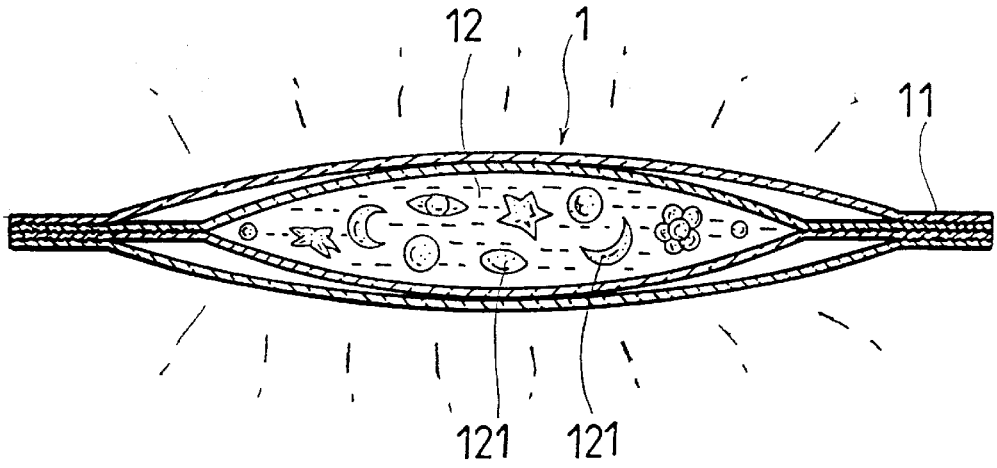
FIG. 5 is a sectional view of another embodiment of the brassiere sash in accordance with the present invention; and, FIG. 6 is a perspective view of an embodiment of the brassiere sashes in accordance with the present invention assembled to a brassiere worn by a user.

Referring o FIG. 5, the brassiere sash 1 of the present invention can be made of more than two layers of overlapping pieces of transparent TPU, to prevent the liquid in the central cavity 12 from permeating therethrough, to wet the wearer's clothes or skin.

While the preferred embodiments of the invention have been described above, it will be recognized and understood that various modifications may be made thereto and the appended claims are intended to cover all such modifications which may fall within the spirit and scope of the invention.

What is claimed is:

1. A brassiere sash comprising:

at least two overlapping pieces of transparent thermoplastic polyurethane, said overlapping pieces being joined on circumferential edges thereof to form a central cavity between said overlapping pieces, said central cavity being filled with liquid, perfume and ornamental glittering articles, each end of said brassiere sash being passed through a buckle ring and then attached to a predetermined other portion of said brassiere sash, said brassiere sash being assembled to a brassiere by said buckle ring.

2. The brassiere sash as recited in claim 1, wherein said ornamental glittering articles are selected from the group consisting of tinsels and variously shaped pieces made from fluorescent powder.

* * * * *